US008245819B2

(12) United States Patent
Hikita et al.

(10) Patent No.: US 8,245,819 B2
(45) Date of Patent: Aug. 21, 2012

(54) REFUGE SUPPORTING DEVICE OF ELEVATOR

(75) Inventors: Shiro Hikita, Tokyo (JP); Kiyoji Kawai, Tokyo (JP); Masahiko Konishi, Tokyo (JP); Masafumi Iwata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 380 days.

(21) Appl. No.: 12/675,908

(22) PCT Filed: Oct. 10, 2007

(86) PCT No.: PCT/JP2007/069758

§ 371 (c)(1), (2), (4) Date: Mar. 1, 2010

(87) PCT Pub. No.: WO2009/047843

PCT Pub. Date: Apr. 16, 2009

(65) Prior Publication Data

US 2010/0213011 A1 Aug. 26, 2010

(51) Int. Cl.
*B66B 1/20* (2006.01)

(52) U.S. Cl. ..... 187/384; 187/314; 187/391; 187/901

(58) Field of Classification Search ..... 187/247, 187/248, 313, 314, 316, 317, 380–388, 391–393, 187/396, 901

See application file for complete search history.

(56) References Cited

U.S. PATENT DOCUMENTS

| | | | | |
|---|---|---|---|---|
| 6,000,505 | A * | 12/1999 | Allen | 187/391 |
| 7,182,174 | B2 * | 2/2007 | Parrini et al. | 182/18 |
| 7,588,126 | B2 * | 9/2009 | Siikonen et al. | 187/384 |
| 7,594,564 | B2 * | 9/2009 | Siikonen et al. | 187/384 |
| 7,669,695 | B2 * | 3/2010 | Hikita et al. | 187/284 |
| 7,677,363 | B2 * | 3/2010 | Kawai | 187/387 |
| 8,113,320 | B2 * | 2/2012 | Kawai et al. | 187/384 |
| 2009/0038892 | A1 * | 2/2009 | Kawai et al. | 187/387 |
| 2010/0213011 | A1 * | 8/2010 | Hikita et al. | 187/247 |
| 2010/0224451 | A1 * | 9/2010 | Hikita et al. | 187/247 |
| 2010/0236868 | A1 * | 9/2010 | Hikita | 187/247 |

FOREIGN PATENT DOCUMENTS

| | | |
|---|---|---|
| JP | 2 106581 | 4/1990 |
| JP | 5 8954 | 1/1993 |
| JP | 5 147849 | 6/1993 |
| JP | 2003 276964 | 10/2003 |
| WO | 2007 083374 | 7/2007 |

* cited by examiner

*Primary Examiner* — Anthony Salata
(74) *Attorney, Agent, or Firm* — Oblon, Spivak, McClelland, Maier & Neustadt, L.L.P.

(57) ABSTRACT

An evacuation support apparatus for an elevator causes an elevator to perform an evacuation operation for conveying people stranded in a building including a plurality of floors to an evacuation floor in an emergency. Further, the evacuation support apparatus for an elevator includes rescue floor setting means for setting the floor determined based on a predetermined condition as a rescue floor, the floor being selected from the plurality of floors, and response floor setting means for registering a call only for the floor on which a call input device for specific persons is operated in a case of the evacuation operation as the call for an evacuation response floor, the call input device for specific persons and a call input device for general persons being provided on each of the plurality of floors. The elevator includes a common car which moves in a reciprocating manner between the rescue floor and the evacuation floor in the case of the evacuation operation. The common car is capable of responding to the registered call for the evacuation response floor in the case of the evacuation operation.

5 Claims, 4 Drawing Sheets

REFUGE SUPPORTING DEVICE OF ELEVATOR

TECHNICAL FIELD

The present invention relates to an evacuation support apparatus for an elevator, which serves to evacuate people stranded in a building when, for example, a fire occurs in the building.

BACKGROUND ART

Conventionally, there has been proposed a system of operating elevators which is designed to perform control operation individually for each of a plurality of elevator groups to stop cars at nearest floors when a fire occurs in a building in which the plurality of elevator groups are installed. An order of priority for starting control operation is set for each of the elevator groups based on a fire occurrence floor. This control operation is started for the elevator groups in the order of the priorities set in advance. Thus, the duration of normal operation of those of the elevator groups which are not significantly influenced by the fire can be extended (see Patent Document 1).

Further, conventionally, there has been also proposed a control apparatus for an elevator which guides a car to a floor other than a fire occurrence floor in the event of a fire (see Patent Document 2).

Patent Document 1: JP 05-8954 A

Patent Document 2: JP 05-147849 A

DISCLOSURE OF THE INVENTION

Problem to be Solved by the Invention

However, in the system of operating the elevators disclosed in Patent Document 1, the duration of normal operation of only one or some of the elevator groups can be extended. After the cars have been stopped through control operation, people in the building cannot be conveyed to an evacuation floor. As a result, the efficiency in conveying people in the building in the event of a fire decreases.

In the control apparatus for the elevator disclosed in Patent Document 2 as well, the car is stopped at a nearest floor through control operation in the event of the fire, so the efficiency in conveying people in the building in the event of the fire decreases.

The present invention has been made to solve the above-mentioned problem, and it is therefore an object of the present invention to provide an evacuation support apparatus for an elevator which makes it possible to suppress the decrease of efficiency in conveying people stranded in the building to the evacuation floor even in the case that of people stranded in the building include, for example, physically-disabled persons.

Means for Solving the Problem

According to the present invention, provided is an evacuation support apparatus for an elevator, for causing an elevator to perform an evacuation operation for conveying people stranded in a building including a plurality of floors to an evacuation floor in an emergency, including: rescue floor setting means for setting a floor determined based on a predetermined condition as a rescue floor, the floor being selected from the plurality of floors; and response floor setting means for registering a call only for the floor on which a call input device for specific persons is operated in a case of the evacuation operation as the call for an evacuation response floor, the call input device for specific persons and a call input device for general persons being provided on each of the plurality of floors, in which: the elevator includes a common car which moves in a reciprocating manner between the rescue floor and the evacuation floor in the case of the evacuation operation; and the common car is capable of responding to the registered call for the evacuation response floor in the case of the evacuation operation.

BEST MODE FOR CARRYING OUT THE INVENTION

A preferred embodiment of the present invention is described hereinafter with reference to the drawings.

First Embodiment

Figure 1:
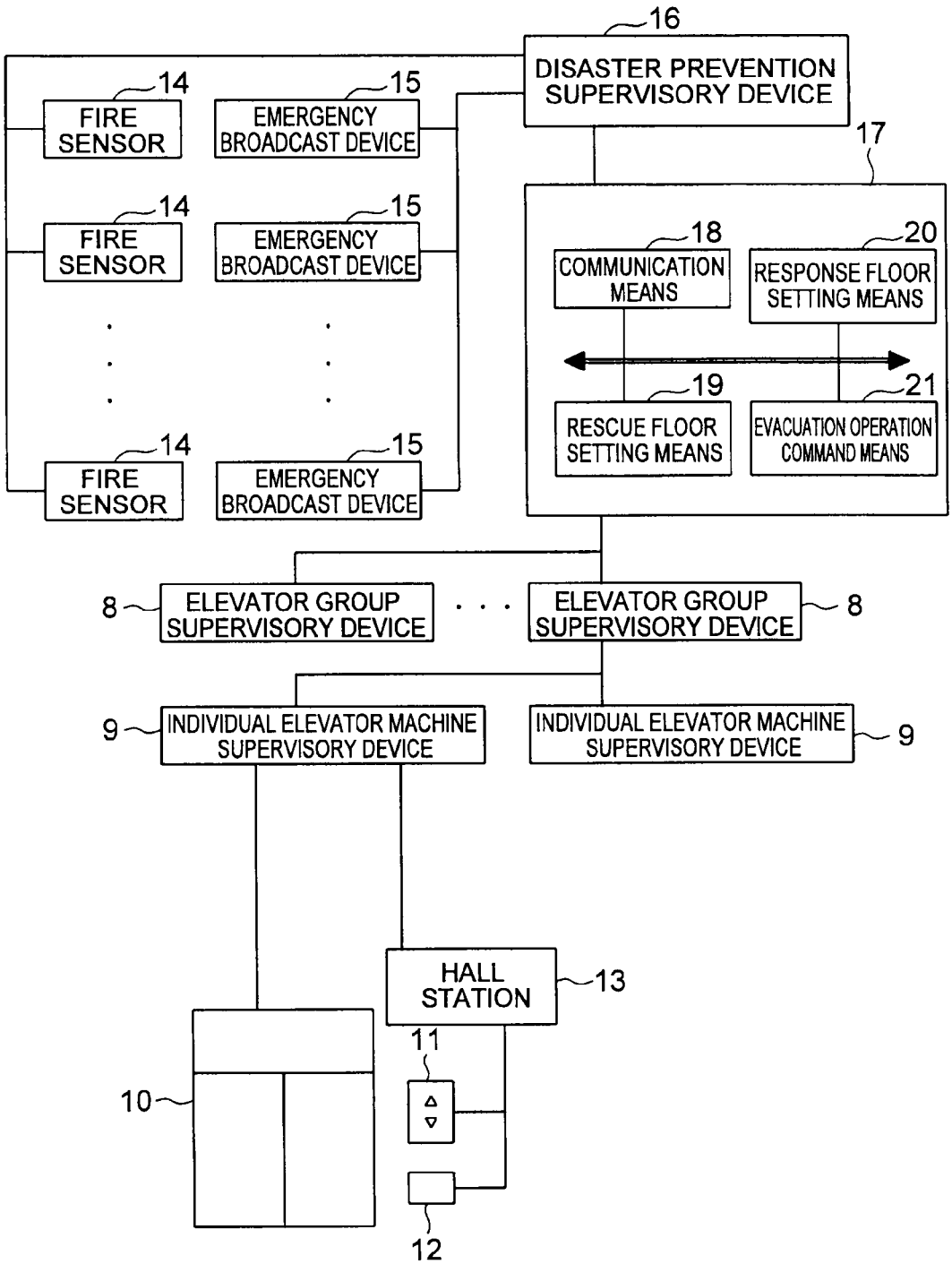
FIG. 1 is a block diagram illustrating an evacuation system including an evacuation support apparatus for an elevator, according to a first embodiment of the present invention.
Figure 2:
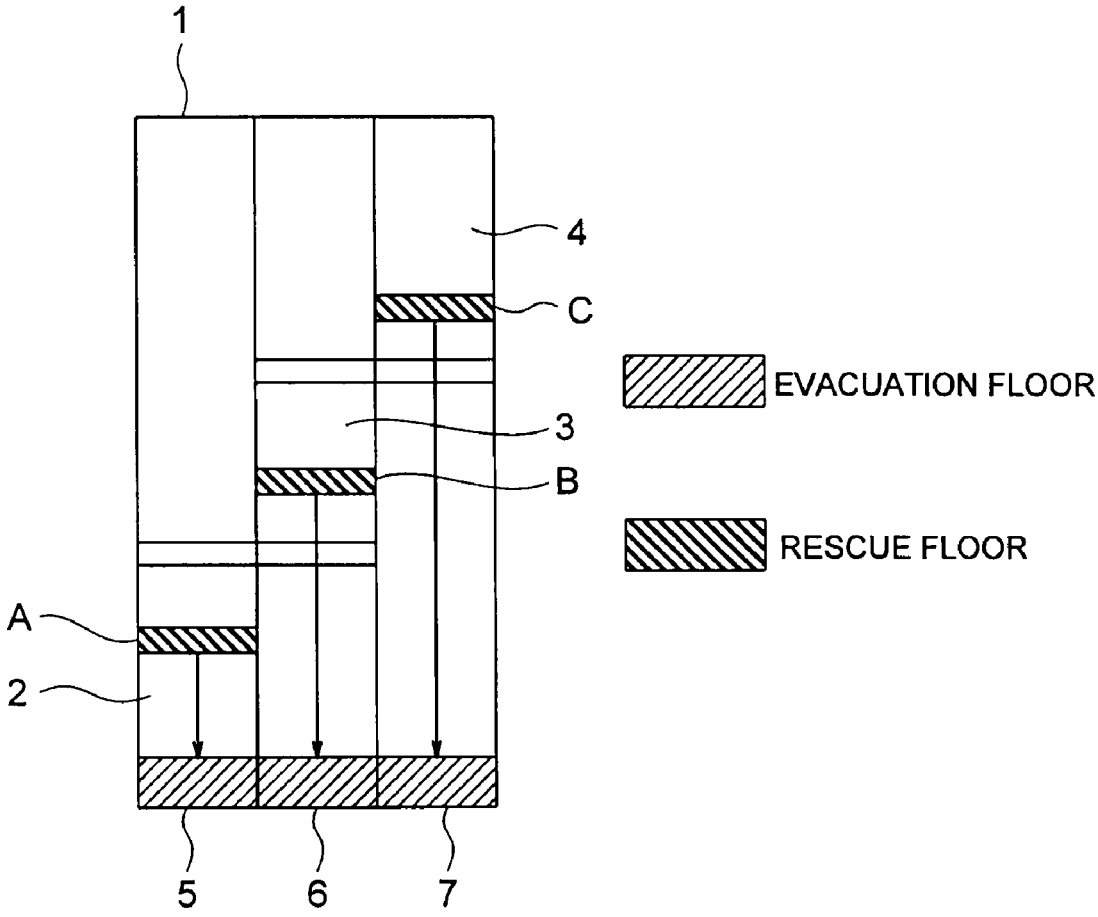
FIG. 2 is a schematic view illustrating a building provided with elevators illustrated in FIG. 1.

FIG. 1 is a block diagram illustrating an evacuation system including an evacuation support apparatus for an elevator according to a first embodiment of the present invention. FIG. 2 is a schematic view illustrating a building provided with elevators illustrated in FIG. 1. In the drawing, a building 1 including a plurality of floors is provided with a low-layer service zone 2, an intermediate-layer service zone 3, and a high-layer service zone 4 (FIG. 2). Each of the service zones 2 to 4 includes a plurality of floors so that the floors included in each of the service zones 2 to 4 at least partially differ from those of each of the other two service zones. The building 1 is also provided with a common evacuation floor that is not included in any one of the service zones 2 to 4. In this example, the evacuation floor is the lowest floor in the building 1, that is, a first floor (entrance floor).

In addition, the building 1 is provided with an elevator 5 on a low-layer bank which is assigned to the floors included in the low-layer service zone 2 as service floors, an elevator 6 on an intermediate-layer bank which is assigned to the floors included in the intermediate-layer service zone 3 as service floors, and an elevator 7 on a high-layer bank which is assigned to the floors included in the high-layer service zone 4 as service floors. That is, the building 1 is provided with the individual elevators 5 to 7 which are assigned to the floors included in the service zones 2 to 4, respectively, as service floors.

Each of the elevators 5 to 7 on the respective banks has a plurality of elevator machines (not shown). Each of the elevators 5 to 7 on the respective banks is provided with a group supervisory device 8 for supervising the operations of the elevator machines as a group, as illustrated in FIG. 1. Each elevator machine is provided with an individual elevator machine supervisory device 9 for controlling the operation of the elevator machine under the supervision of the group supervisory device 8.

Each of the elevator machines includes a common car 10 which is capable of conveying a passenger. The common car 10 of each of the elevator machines in the elevator 5 on the low-layer bank is allowed to stop at the service floors in the low-layer service zone 2. The common car 10 of each of the elevator machines in the elevator 6 on the intermediate-layer bank is allowed to stop at the service floors in the intermediate-layer service zone 3. The common car 10 of each of the elevator machines in the elevator 7 on the high-layer bank is allowed to stop at the service floors in the high-layer service zone 4. Further, each of the common cars 10 is allowed to stop even at the evacuation floor.

A hall button device (call input device for general persons) 11 and a card reader (call input device for specific persons) 12, each for registering a call for the common car 10 made on a landing, are provided to the landing on each floor. The hall button device 11 and the card reader 12 are controlled by a hall station 13 provided on each of the floors. The card reader 12 is located at a position lower than that of the hall button device 11.

The hall button device 11 is operated by, for example, a non-disabled person, whereas the card reader 12 is operated by, for example, a physically-disabled person, an elderly person, or the like. The card reader 12 is operated by passing a card carried by a person in the building through the card reader 12 to allow the card reader 12 to read personal information. Whether or not the call can be registered by the operation of the card reader 12 is judged by comparing the acquired personal information read by the card reader 12 and registered personal information that has been registered in advance. Specifically, the card reader 12 serves as a personal ID identification device for identifying whether or not the person in the building is a pre-registered one.

When the call registration is performed on any of the landings of the respective floors, any one of the common cars 10 of the elevator including a target floor for which the call has been registered as the service floor responds to the registered call. The assignment of the common car 10 responding to the registered call is performed by the group supervisory device 8. The common car 10 assigned by the group supervisory device 8 is moved to the target floor for which the call has been registered by the control of the individual elevator machine supervisory device 9.

Each of the floors of the building 1 is provided with a fire sensor 14 for sensing the occurrence of a fire and an emergency broadcast device 15 for broadcasting an announcement for an evacuation guidance throughout the building 1. Information from each of the fire sensors 14 is transmitted to a disaster prevention supervisory device 16 for controlling disaster prevention components in the entire building 1 comprehensively. The disaster prevention supervisory device 16 detects whether or not a fire has occurred and identifies a fire occurrence floor based on the information from each of the fire sensors 14.

Information from the disaster prevention supervisory device 16 is transmitted to an evacuation support apparatus 17 for supervising each of the group supervisory devices 8 in the event of a fire (in an emergency). The evacuation support apparatus 17 comprehensively controls the group supervisory devices 8 after the detection of the occurrence of the fire by the disaster prevention supervisory device 16, thereby causing each of the elevators 5 to 7 to perform an evacuation operation for conveying people stranded in the building 1 to the evacuation floor. The disaster prevention supervisory device 16 and the evacuation support apparatus 17 are provided in a control room (disaster prevention center) for monitoring and controlling equipment for disaster prevention in a centralized manner.

The evacuation support apparatus 17 includes a communication means 18, a rescue floor setting means 19, a response floor setting means 20, and an evacuation operation command means 21.

The communication means 18 allows each of the group supervisory devices 8 and the disaster prevention supervisory device 16 to exchange information with the evacuation support apparatus 17.

The rescue floor setting means 19 sets floors determined based on a predetermined condition as rescue floors. In this example, the rescue floors are predetermined based on a structure of the building 1.

Among the service floors included in the respective service zones 2 to 4, the rescue floor setting means 19 sets a first rescue floor A for the low-layer service zone 2, a second rescue floor B for the intermediate-layer service zone 3, and a third rescue floor C for the high-layer service zone 4 (FIG. 1).

The determination of each of the rescue floors is performed by vertically separating the building 1 into a plurality of separate zones (4 zones in this example) and setting, among each of the separate zones, the lowest floor in each of the separate zones other than the lowest separate zone as the rescue floors A to C, respectively. The number of the separate zones is larger than the number of the respective service zones 2 to 4 by one. That is, in the building 1 provided with elevators on N banks, the determination of each of the rescue floors is performed by separating the building 1 into (N+1) separate zones and setting, among each of the separate zones, each of the lowest floors in the N separate zones other than the lowest separate zone as each of the rescue floors.

The people in each of the separate zones move to a corresponding one of the rescue floors A to C located below or the evacuation floor by taking stairs. Specifically, the people in the separate zone located above the first rescue floor C move to the third rescue floor C by taking the stairs, whereas the people in the separate zone located between the third rescue floor C and the second rescue floor B move to the second rescue floor B by taking the stairs. Moreover, the people in the separate zone located between the second rescue floor B and the first rescue floor A move to the first rescue floor A by taking the stairs, whereas the people in the separate zone located below the first rescue floor A move to the evacuation floor by taking the stairs.

Each of the rescue floors A to C is set so that the people in each of the separate zones cover the same distance in moving to a corresponding one of the rescue floors or to the evacuation floor by taking the stairs. Each of the rescue floors A to C may be set so that the sum of a time required for the people in the building to move by taking the stairs and a conveyance time for conveying the people in the building from each of the rescue floors to the evacuation floor becomes the same for the rescue floors.

The response floor setting means 20 registers the call only for the floor on which the card reader 12 selected from the set of the hall button device 11 and the card reader 12 is operated in the case of the evacuation operation as the call for the evacuation response floor. Therefore, for the floor on which only the hall button device 11 selected from the set of the hall button device 11 and the card reader 12 is operated in the case of the evacuation operation, the response floor setting means 20 rejects the call registration for the floor as the evacuation response floor.

The evacuation operation command means 21 transmits an evacuation operation command for causing the elevators 5 to 7 on the respective banks to perform the evacuation operation to each of the group supervisory devices 8. Upon transmission of information of determination of occurrence of the fire in the building 1 from the disaster prevention supervisory device 16 to the evacuation support apparatus 17 and the setting of the rescue floors by the rescue floor setting means 19, the evacuation operation command means 21 outputs the evacuation operation command.

Upon reception of the information of the determination of the occurrence of the fire from the disaster prevention supervisory device 16 through the evacuation support apparatus 17, the elevators 5 to 7 on the respective banks perform a control operation in the event of a fire. The control operation in the event of a fire is an operation for stopping the common cars 10 at the nearest floors. Moreover, in response to the evacuation operation command from the evacuation support apparatus 17, the elevators 5 to 7 on the respective banks perform the evacuation operation. The evacuation operation is an operation for moving the common cars 10 between the rescue floors set by the rescue floor setting means 19 and the preset evacuation floor (entrance floor) in a reciprocating manner. Each of the common cars 10 is capable of responding to the registered call for the evacuation response floor in the case of the evacuation operation.

Specifically, in the elevators 5 to 7 in the case of the evacuation operation, the common cars 10 are moved, in principle, in a reciprocating manner between the rescue floors and the evacuation floor. Moreover, when the call for the evacuation response floor is registered by the response floor setting means 20 in the case of the evacuation operation, the common cars 10 responding to the registered call are moved to the evacuation response floor in one of the elevators 5 to 7, which includes the evacuation response floor as the service floor. After each of the common cars 10 arriving at the evacuation response floor picks up the people, the common cars 10 are moved to the evacuation floor. After the common car 10 arriving at the evacuation floor unloads the people, the common car 10 is moved again in a reciprocating manner between the rescue floor and the evacuation floor.

The evacuation support apparatus 17 includes a computer including a calculation processing portion (CPU), a storage portion (ROM, RAM, or the like), and signal input/output portions. The functions of the communication means 18, the rescue floor setting means 19, the response floor setting means 20, and the evacuation operation command means 21 are realized by the computer constituting the evacuation support apparatus 17.

That is, programs for realizing the functions of the communication means 18, the rescue floor setting means 19, the response floor setting means 20, and the evacuation operation command means 21 are stored in the storage portion of the computer. Information such as predetermined conditions to determine each of the rescue floors A to C or the like is also stored in the storage portion. The calculation processing portion performs a calculation processing regarding the function of the evacuation support apparatus 17 based on the programs stored in the storage portion.

Figure 3:
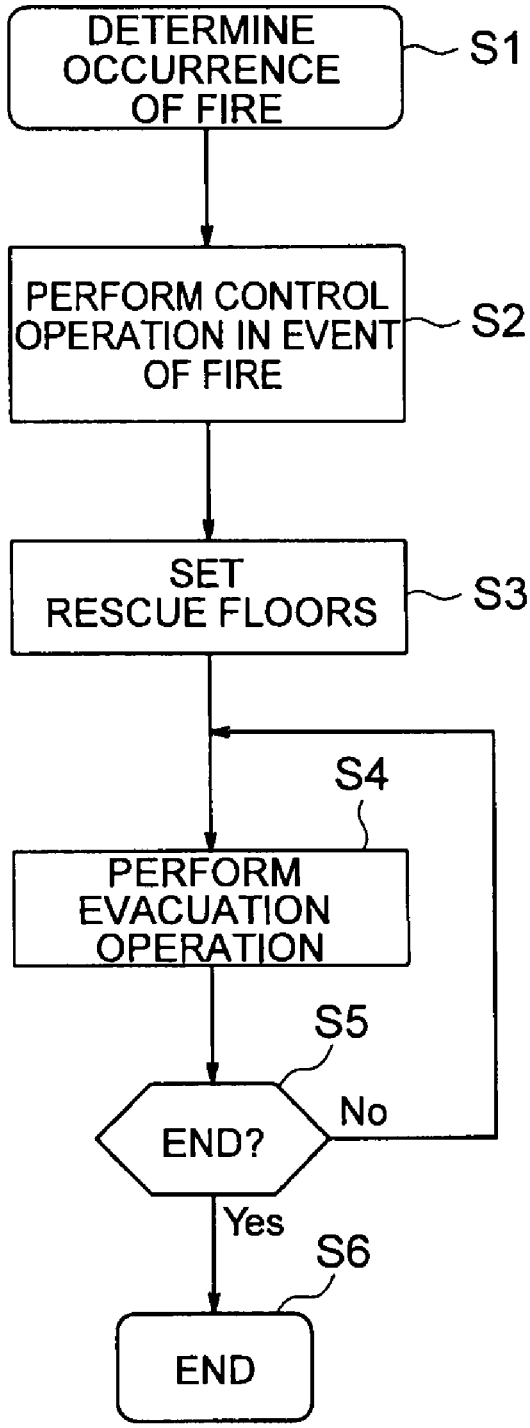
FIG. 3 is a flowchart for describing an operation of the evacuation system illustrated in FIG. 1.

Next, an operation is described. FIG. 3 is a flowchart for describing an operation of the evacuation system illustrated in FIG. 1. As illustrated in the drawing, upon determination of the occurrence of the fire by the disaster prevention supervisory device 16 (S1), the information of the determination of the occurrence of the fire is transmitted from the disaster prevention supervisory device 16 to the evacuation support apparatus 17 and each of the group supervisory devices 8. As a result, the operation of each of the elevators 5 to 7 is switched to the control operation in the event of a fire. The moving common cars 10 are stopped at the nearest floors to wait in a door-open state (S2).

Upon reception of the information of the determination of the occurrence of the fire by the evacuation support apparatus 17, each of the rescue floors A to C is set by the rescue floor setting means 19 (S3).

After that, the evacuation operation command is output from the evacuation support apparatus 17 to each of the group supervisory devices 8. As a result, the evacuation operation for each of the elevators 5 to 7 is performed under the supervision of the group supervisory devices 8 (S4). Each of the common cars 10 is moved in a reciprocating manner between the rescue floor and the evacuation floor by the evacuation operation of the elevators. The people who are present on any one of the rescue floors A to C are conveyed from the corresponding one of the rescue floors to the evacuation floor by the reciprocating movement of each of the common cars 10.

In the case of the evacuation operation, an announcement is broadcast throughout the building by each of the emergency broadcast devices 15 under the supervision of the evacuation support apparatus 17. As a result, the people present in each of the separate zones go down by taking the stairs of the building 1 to be guided to any one of the rescue floors A to C and the evacuation floor.

After that, the evacuation support apparatus 17 judges whether or not termination condition of the evacuation operation is satisfied (S5). It is determined that the termination condition of the evacuation operation is satisfied, for example, when a termination button installed in each of the elevators 5 to 7 is operated, when an abnormality detecting sensor installed in each of the elevators 5 to 7 is actuated due to the spread of the fire, the inundation resulting from fire fighting, or the like, or when the absence of people getting on the common cars 10 at each of the rescue floors is detected by a boarding/disembarkation sensor or the like. That is, the termination condition of the evacuation operation is satisfied when the continuation of evacuation operation becomes difficult or when a condition for completing evacuation operation is satisfied.

When the termination condition is not satisfied, the evacuation operation of each of the elevators 5 to 7 is continued (S4). In this case, the announcement in the building is also continuously broadcast by each of the emergency broadcast devices 15. When the termination condition is satisfied, the evacuation operation of each of the elevators 5 to 7 is terminated in response to a termination command from the evacuation support apparatus 17 to the group supervisory devices 8 (S6).

In the case of the evacuation operation, the hall button device 11 or the card reader 12 is operated in some cases. When the acquired personal information read by the card reader 12 on the floor other than the rescue floors is proper in the case of the evacuation operation, the call for the floor on which the card reader 12 has been operated is registered as the call for the evacuation response floor by the response floor setting means 20. On the other hand, when the hall button device 11 is operated in the case of the evacuation operation, the call for the floor as the evacuation response floor is rejected to be registered. Therefore, in the case of the evacuation operation, the call is not registered by the operation of the hall button device 11.

Figure 4:
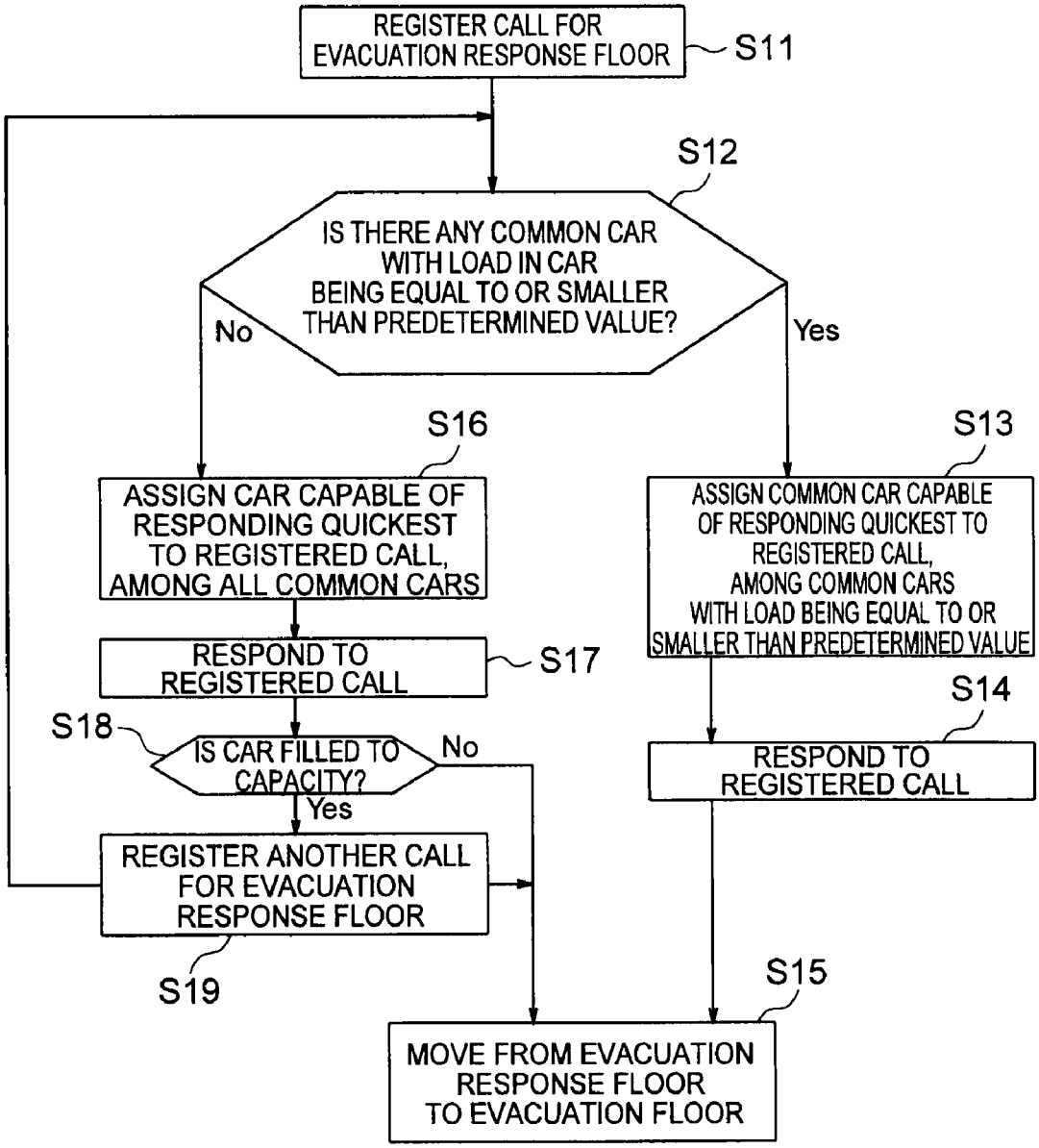
FIG. 4 is a flowchart for describing an operation of each of elevators 5 to 7 when a call for an evacuation response floor is registered by response floor setting means 20 illustrated in FIG. 1.

Next, an operation of each of the elevators 5 to 7 when the call is registered for the evacuation response floor in the case of the evacuation operation is described. FIG. 4 is a flowchart for describing the operation of each of the elevators 5 to 7 when the call is registered for the evacuation response floor by the response floor setting means 20 illustrated in FIG. 1. As illustrated in the drawing, when the call for the evacuation response floor is registered (S11), the group supervisory device 8 judges whether or not there is any common car 10 (candidate car) with a load in the car, which is equal to or smaller than a predetermined value, among the common cars 10 (S12). Specifically, the group supervisory device 8 judges whether or not any one of the conditions, that is, each of the common cars 10 is vacant (specifically, there is no load in each of the common cars 10) and the load is equal to or smaller than the predetermined value even if there is the load in the common car 10, is satisfied. The load in each of the common cars 10 is obtained, for example, based on information from a weighing device or the like provided to each of the common cars 10.

After picking up the people at the rescue floor, each of the common cars 10 moves from the rescue floor to the evacuation floor to unload the people at the evacuation floor. Therefore, when there is the load (specifically, when the people are carried) in the car, the common car 10 always descends.

When there are the candidate cars, the group supervisory device 8 assigns the common car 10 selected from the candidate cars, which is capable of responding quickest to the registered call for the evacuation response floor, as a selected car (S13). After that, the corresponding individual elevator machine supervisory device 9 causes the selected car to respond to the registered call for the evacuation response floor (S14) to subsequently move the selected car from the evacuation response floor to the evacuation floor (S15).

When there is no candidate car, the group supervisory device 8 assigns the common car 10 selected from all the common cars 10, which is capable of responding quickest to the registered call for the evacuation response floor, as the selected car (S16). After that, the corresponding individual elevator machine supervisory device 9 causes the selected car to respond to the registered call for the evacuation response floor (S17). As a result, the people on the evacuation response floor ride on the selected car. After that, the individual elevator machine supervisory device 9 judges whether or not the selected car is filled to capacity (specifically, whether or not the load in the car has reached an allowable value for the selected car) (S18).

When the selected car is not filled to capacity, the corresponding individual elevator machine supervisory device 9 moves the selected car from the evacuation response floor to the evacuation floor (S15).

When the selected car is filled to capacity, it is believed that more people are left on the evacuation response floor (specifically, there are unloaded people). Therefore, the individual elevator machine supervisory device 9 performs another call registration for the evacuation response floor (S19). After that, the corresponding individual elevator machine supervisory device 9 moves the selected car from the evacuation response floor to the evacuation floor (S15). The group supervisory device 8 judges whether or not there are any common cars 10 (candidate cars) with the load in the car, which is equal to or smaller than the predetermined value (S12). The operation after the judgment for the candidate cars is the same as that described above. In this manner, all the people stranded on the evacuation response floor are conveyed to the evacuation floor.

After that, each of the common cars 10 is moved again in a reciprocating manner between the rescue floor and the evacuation floor under the supervision of the group supervisory device 8.

In the evacuation support apparatus 17 for the elevator, as described above, the rescue floors are set by the rescue floor setting means 19. The call is registered by the response floor setting means 20 only for the floor, on which the card reader 12 has been operated in the case of the evacuation operation, as the evacuation response floor. In the case of the evacuation operation, the common cars 10 are moved in a reciprocating manner between the rescue floors and the evacuation floor and also respond to the registered call for the evacuation response floor. Therefore, the number of the floors, at which the common cars 10 stop in the case of the evacuation operation, can be reduced, thereby improving the efficiency in conveying the people in the building 1 to the evacuation floor. Moreover, even when the specific person such as the physically-disabled person, the elderly person, or the like, who has difficulty in moving by taking the stairs, is present on the floor which is different from the rescue floors in the case of the evacuation operation, the common car 10 can be called to the corresponding floor by the operation of the card reader 12. As a result, the specific person can be evacuated to the evacuation floor without suffering from a burden of, for example, the movement by taking the stairs or the like. Therefore, even when, for example, the physically-disabled person or the elderly person is included in the people stranded in the building 1, the efficiency in conveying the people in the building to the evacuation floor can be prevented from being lowered.

Moreover, the common car 10 with the load in the car, which is equal to or smaller than the predetermined value, responds to the registered call for the evacuation response floor, and hence the people present on the evacuation response floor can more reliably ride on the common car 10. Specifically, it is expected that the common car 10 is filled to capacity on the rescue floor by loading a large number of people. Therefore, even if the common car 10 responds to the registered call for the evacuation response floor after responding to the registered call for the rescue floor, it is difficult to load more people in the common car 10 because the common car 10 has already been filled to capacity. Therefore, the common car 10 with the load in the car, which is equal to or smaller than the predetermined value, and therefore, with some room, is caused to first respond to the registered call for the evacuation response floor on the priority basis. As a result, the people present on the evacuation response floor can more reliably ride on the common car 10.

The card reader 12 corresponding to the personal ID identification device serves as the call input device for specific persons, and hence, for example, the non-disabled person who can easily move by taking the stairs is prevented from registering the call for the evacuation response floor. As a result, the common car 10 can be prevented from unnecessarily stopping at the evacuation response floor, thereby preventing the efficiency in conveying the people in the building from being lowered due to the evacuation operation.

Although the card reader 12 is used as the call input device for specific persons in the example described above, the call input device for specific persons is not limited thereto. For example, a personal ID identification device for performing personal identification with an IC tag may be used as the call input device for specific persons. A hall button device for wheelchair users, which has an operation button, may also be used as the call input device for specific persons. Even in this manner, for example, the physically-disabled person, the elderly person, or the like can operate the call input device for specific persons. Therefore, the common car 10 can be called to the evacuation response floor on which the call input device for specific persons has been operated. Therefore, for example, the physically-disabled person, the elderly person, or the like can be efficiently conveyed to the evacuation floor.

Although the rescue floors are determined based on the structure of the building 1 in the above-mentioned example, a method of determining the rescue floors is not limited thereto. The rescue floors may be determined, for example, based on the fire occurrence floor.

Moreover, although the evacuation operation is performed in an emergency where the fire occurs in the building 1 in the above-mentioned example, the evacuation operation may also be performed even in an emergency where, for example, warning of a terrorism attack is received. In this case, information of the warning of the terrorism attack is input to the evacuation support apparatus 17 by an operation of an external input device provided in the control room (disaster prevention center).

Further, although each of the elevators 5 to 7 has the common cars 10 to be moved in a reciprocating manner between the rescue floor and the evacuation floor in the case of the evacuation operation in the above-mentioned example, each of the elevators 5 to 7 may further include a car exclusively for specific persons, which is allowed to respond only to the registered call for the evacuation response floor in the case of the evacuation operation, in addition to the common car 10. Specifically, in each of the elevators 5 to 7, a part of the elevator machines selected from the plurality of elevator machines may serve as the elevator machine (s) for specific persons, whereas the remaining elevator machines may serve as the common elevator machines for general and specific persons. In this case, only when the call is registered for the evacuation response floor, the car exclusively for the special persons in the case of the evacuation operation moves to the evacuation response floor to pick up the people on the evacuation response floor, and then moves to the evacuation floor. When the call registration for the evacuation response floor is avoided in the case of the evacuation operation, the car exclusively for the specific persons waits at a predetermined floor.

In this manner, the use of the elevators by the specific persons who have difficulty in moving by taking the stairs can be prevented from being inhibited by another person in the building. Therefore, the specific persons on the evacuation response floor can be more reliably conveyed to the evacuation floor.

The invention claimed is:

1. An evacuation support apparatus for an elevator, for causing an elevator to perform an evacuation operation for conveying people stranded in a building including a plurality of floors to an evacuation floor in an emergency, comprising:

rescue floor setting means for setting a floor determined based on a predetermined condition as a rescue floor, the floor being selected from the plurality of floors; and response floor setting means for registering a call only for the floor on which a call input device for specific persons is operated in a case of the evacuation operation as the call for an evacuation response floor, the call input device for specific persons and a call input device for general persons being provided on each of the plurality of floors, wherein:

the elevator includes a common car which moves in a reciprocating manner between the rescue floor and the evacuation floor in the case of the evacuation operation; and the common car is capable of responding to the registered call for the evacuation response floor in the case of the evacuation operation.

2. An evacuation support apparatus for an elevator, according to claim 1, wherein the elevator causes the common car with a load in the car, which is equal to or smaller than a predetermined value, to respond to the registered call for the evacuation response floor.

3. An evacuation support apparatus for an elevator, according to claim 1, wherein the call input device for specific persons comprises a personal ID identification device.

4. An evacuation support apparatus for an elevator, according to claim 1, wherein the call input device for specific persons is a hall button device for wheelchair users, which is located at a position lower than a position of the call input device for general persons.

5. An evacuation support apparatus for an elevator, according to claim 1, wherein:

the elevator further comprises a car exclusively for specific persons; and the car exclusively for specific persons is capable of responding only to the registered call for the evacuation response floor in the case of the evacuation operation.

* * * * *